US005718362A

United States Patent [19]

Silverman

[11] Patent Number: 5,718,362

[45] Date of Patent: Feb. 17, 1998

[54] GARMENT HANGER

[76] Inventor: Harvey I. Silverman, 5831 NW. 56th Pl., Tamarac, Fla. 33319

[21] Appl. No.: 761,353

[22] Filed: Dec. 6, 1996

Related U.S. Application Data

[63] Continuation-in-part of Ser. No. 515,897, Aug. 16, 1995, abandoned.

[51] Int. Cl.[6] ..... A47G 25/44; A47G 25/14

[52] U.S. Cl. ..... 223/94; 223/92; 223/98; 223/89; 223/85

[58] Field of Search ..... 223/85, 89, 94, 223/98, 92; D6/315, 324

[56] References Cited

U.S. PATENT DOCUMENTS

| | | | |
|---|---|---|---|
| 779,062 | 1/1905 | Beatty . | |
| 2,494,711 | 1/1950 | Kusher et al. | 223/94 |
| 2,652,958 | 9/1953 | Alvord | 223/94 |
| 2,666,561 | 1/1954 | Welker | 223/94 |
| 2,679,958 | 6/1954 | Massa et al. | 223/89 |
| 2,754,039 | 7/1956 | Pierce | 223/94 |
| 2,814,426 | 11/1957 | Miller | 223/94 |
| 2,819,828 | 1/1958 | Thurber | 223/89 |
| 2,884,171 | 4/1959 | Knuth | 223/98 |
| 3,188,675 | 6/1965 | Beck | 223/94 |
| 3,443,729 | 5/1969 | Hannum | 223/94 |
| 3,874,572 | 4/1975 | McClenning | 223/94 |
| 4,026,447 | 5/1977 | Wnek | 223/98 |
| 4,717,053 | 1/1988 | Wang | 223/94 |
| 4,905,877 | 3/1990 | Gatling | 223/90 |
| 5,085,357 | 2/1992 | Chen | 223/85 |
| 5,085,358 | 2/1992 | Lam | 223/94 |
| 5,145,098 | 9/1992 | Tung | 223/94 |
| 5,163,627 | 11/1992 | Marks | 223/85 |

FOREIGN PATENT DOCUMENTS 184332 5/1955 Germany .

*Primary Examiner*—Bibhu Mohanty
*Attorney, Agent, or Firm*—Robert C. Kain, Jr.

[57] ABSTRACT

In one embodiment, the telescopic sleeve overlay for a garment hanger is used in conjunction with a common type hanger. Common hangers usually are made of wire or stiff rods which form a shallow, inverted U-shape depending from an inverted U-shaped hanger head. The hanger head is adapted to be hung on a clothing rod. The sleeve overlay includes an inverted U-shaped base and two longitudinally movable inverted U-shaped sleeves. The sleeves move inboard and outboard on the base and move with respect to a centrally located cut-out on the base. The hanger head from the hanger extends through the cut-out. The base extends longitudinally over substantially the entire length of the hanger wire. In one embodiment, the sleeves are guided on the base by guides formed either at the lower edges of the sleeves or at the lower edges of the base. Inboard and outboard stops prevent the sleeves from being completely withdrawn from the base or being forced towards the apex of the hanger. A hanger head is utilized having an inverted U-shaped hanger hook and a par of legs extending in opposite directions from a base portion of the hanger hook. Each leg has an upstanding clip tab thereat. The base of the garment hanger defines an inverted, U-shaped lateral cross-section and a longitudinally centered cut-out The hanger head protrudes through the cut-out and each upstanding clip tab removably locks onto an edge portion which defines the base cut-out. A pair of longitudinally moveable, inverted U-shaped sleeves are movably mounted atop opposing end regions of the base.

16 Claims, 4 Drawing Sheets

FIG. 10

GARMENT HANGER

This is a continuation-in-part of U.S. patent application Ser. No. 08/515,897, filed Aug. 16, 1995, now abandoned.

The present invention relates to a garment hanger with telescopic sleeves.

BACKGROUND OF THE INVENTION

U.S. Pat. No. 5,145,098 to Tung discloses a foldable and telescopic garment hanger. The Tung hanger includes extending, planar members that extend from and retract into a central base.

U.S. Pat. No. 5,344,054 to Nutter discloses a hanger with shoulders comprising stationary arms with U-shaped slots into which adjustable T-shaped sliding arms are inserted. A laterally disposed spring-and-screw tension device acts as a stop to secure each of the adjustable arms at the desired shoulder width.

U.S. Pat. No. 2,494,711 to Kusher discloses a hanger with adjustable rectangular sleeves that slide along smaller, rectangular notched arms of the hanger until the desired width is obtained. Each sleeve is secured to its corresponding arm by the engagement of the lateral sleeve pin and the arm notch.

U.S. Pat. No. 4,905,877 to Gatling discloses a hanger wherein each shoulder-arm has a slidable rectangular sleeve. Stops on each sleeve and notches on each shoulder-arm are selectively engaged to adjust the hanger to the desired shoulder width.

U.S. Pat. No. 2,814,426 to Miller discloses a hanger with telescoping adjustable shoulders.

U.S. Pat. No. 2,819,828 to Thurber discloses a hanger with shoulder support pads that slide along the hanger arms and are adjustable for obtaining a desired shoulder width.

U.S. Pat. No. 3,443,729 to Hannum discloses a hanger with telescoping shoulders extendable to various widths.

U.S. Pat. No. 2,679,958 to Massa discloses a hanger with arms consisting of movable wings having openings for movement about the anchoring pegs, thus permitting shoulder width adjustment.

U.S. Pat. No. 2,754,039 to Pierce discloses a hanger with rigid channel arms, within which are mounted slidable auxiliary arms that allow the hanger to be adjusted to various shoulder widths.

U.S. Pat. No. 4,717,053 to Wang discloses a hanger with slidable shoulder sections that can be set at various positions by having the tapered bump, present on each of the slidable extension arms, engage any one of the plurality of recesses along the main arm channels.

U.S. Pat. No. 5,085,358 to Lam discloses a hanger with extender arms that move along the shoulder arm recesses until the desired shoulder width is obtained. The extender arm each have a locking pin that secures each extender arm to the recess at the desired position. The extender arms are also equipped with shoulder support pads.

U.S. Pat. No. 2,666,561 to Welker discloses a hanger with extension arms slidably mounted in a slotted channel for adjustment to various garment widths. Slidably overlying each arm is a shoulder support element that moves in relation to the motion of the extension arms.

U.S. Pat. No. 3,188,675 to Beck discloses a hanger with extendable tubular shoulders.

U.S. Pat. No. 3,874,572 to McClenning discloses a hanger with slidable shoulder sections that can be set at various positions between the fully retracted and fully extended positions.

U.S. Pat. No. 2,652,958 to Alvord discloses an adjustable garment hanger but does not show, teach or suggest any type of cut-out on the sleeve end pieces for clothing straps.

U.S. Pat. No. 779,062 to Beatty discloses a clothing hanger having fingers or stops and locking studs. No clothing strap cut-outs are present on the sleeves of Beatty.

U.S. Pat. No. 2,884,171 to Knuth discloses a garment hanger having movable pieces which travel n a clothing hanger wire. The top surface of sleeve attachment is smooth.

U.S. Pat. No. 2,494,711 to Kusher discloses sleeves that travel on a specially configured hanger bar. Again, the top surface of the sleeve does not include a strap cut-out.

German patent publication 184332 discloses what appears to be a hanger with a uniform smooth top surface.

U.S. Pat. No. 5,145,098 to Tung discloses a foldable and telescopic garment hanger. In one figure, Tung discloses a strap cut-out which is configured as part of the hanger bar. As such, the strap cut-out is not disposed on the movable sleeve. The strap cut-out of Tung cannot be moved to accommodate a wide variety of straps. The strap cut-outs in Tung are permanent and do not move.

U.S. Pat. No. 4,905,877 to Gatling discloses an adjustable garment hanger. The Gatling garment hanger includes movable sleeves that have a smooth exterior top surface.

U.S. Pat. No. 2,814,426 to Miller discloses a clothing hanger. The Miller clothing hanger has a plurality of holes along its top surface. The user depresses a tap and thereby permits a sleeve extender to be retracted or extended from the base unit.

U.S. Pat. No. 2,819,828 to Thurber discloses an adjustable coat hanger. The adjustable coat hanger of Thurber includes a smooth top surface without strap cut-outs.

U.S. Pat. No. 3,443,729 to Hannum discloses an adjustable coat hanger. The adjustable coat hanger of Hannum does not show, teach or suggest strap cut-outs.

U.S. Pat. No. 2,679,958 to Massa discloses a garment hanger. The garment hanger of Massa has a smooth top surface.

U.S. Pat. No. 2,754,039 to Pierce discloses an extensible and retractable coat hanger. The coat hanger of Pierce has a smooth upper surface.

U.S. Pat. No. 4,717,053 to Wang discloses an extendible and foldable garment hanger. This garment hanger includes an open top surface but does not show, teach or suggest strap cut-outs.

U.S. Pat. No. 5,085,358 to Lam discloses an adjustable clothes hanger. The adjustable clothes hanger of Lam includes a base having a substantially smooth top surface and a rotatable extender arm that also has a relatively smooth top surface.

U.S. Pat. No. 2,666,561 to Welker discloses an adjustable garment hanger. The adjustable garment hanger of Welker has a smooth top surface on base and extendible sleeves.

U.S. Pat. No. 3,874,572 to McClenning discloses a collapsible hanger. The collapsible hanger of McClenning includes a base having a smooth top surface. Extendible arms also have smooth top surfaces.

OBJECTS OF THE INVENTION

It is an object of the present invention to provide a garment hanger with telescoping sleeves.

It is another object of the present invention to provide a sleeve overlay which fits atop a hanger base which form the inverted U-shape.

It is another object of the present invention to provide a garment hanger wherein the overlay has an inverted U-shape lateral cross-section and a longitudinally centered cut-out through which protrudes the hanger head. U-shaped sleeves move over each end of the base.

It is an additional object of the present invention to provide telescopic sleeves that can easily be altered to accommodate a wide variety of clothing such as suits, dresses and jackets. The inverted U-shaped base and the movable U-shaped sleeves mounted atop the base enable the user to extend and retract the sleeves over the base thereby providing support for the entire shoulder region of the jacket, suit, dress or clothing article.

It is a further object of the present invention to include strap cut-outs on the telescopic sleeves such that the strap cut-outs can be longitudinally adjusted to accommodate a wide variety of clothing sizes, strap lengths and strap positions.

It is another object of the present invention to utilize a clip-on and clip-off hanger head. This enables the user to select different colored or sized hanger heads to designate clothing having different sizes, different styles, different prices or different manufacturers.

SUMMARY OF THE INVENTION

In one embodiment, the telescopic sleeve overlay for a garment hanger is used in conjunction with a common type hanger. Common hangers usually are made of wire or stiff rods which form a shallow, inverted U-shape depending from an inverted U-shaped hanger head. The hanger head is adapted to be hung on a clothing rod. The sleeve overlay includes an inverted U-shaped base and two longitudinally movable inverted U-shaped sleeves. The sleeves move inboard and outboard on the base and move with respect to a centrally located cut-out on the base. The hanger head from the hanger extends through the cut-out. The hanger wire or rod is positioned within the apex of the inverted U-shaped base. The base extends longitudinally over substantially the entire length of the hanger wire. In one embodiment, the sleeves are guided on the base by guides formed either at the lower edges of the sleeves or at the lower edges of the base. Inboard and outboard stops prevent the sleeves from being completely withdrawn from the base or being forced towards the apex of the hanger. In one embodiment, the sleeve overlay is made of plastic. In another embodiment, the sleeve overlay is made of paper or cardboard. In a further enhancement, the base includes a reinforcement member disposed in the apex of the inverted U-shaped base.

In another embodiment, the garment hanger has telescoping sleeves. A hanger head is utilized having an inverted U-shaped hanger hook and a par of legs extending in opposite directions from a base portion of the hanger hook. Each leg has an upstanding clip tab thereat. The base of the garment hanger defines an inverted, U-shaped lateral cross-section and a longitudinally centered cut-out. The hanger head protrudes through the cut-out and each upstanding clip tab removably locks onto an edge portion which defines the base cut-out. A pair of longitudinally moveable, inverted U-shaped sleeves are movably mounted atop opposing end regions of the base.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a telescopic sleeve overlay for a garment hanger and a garment hanger with telescopic sleeves.

Figure 1:
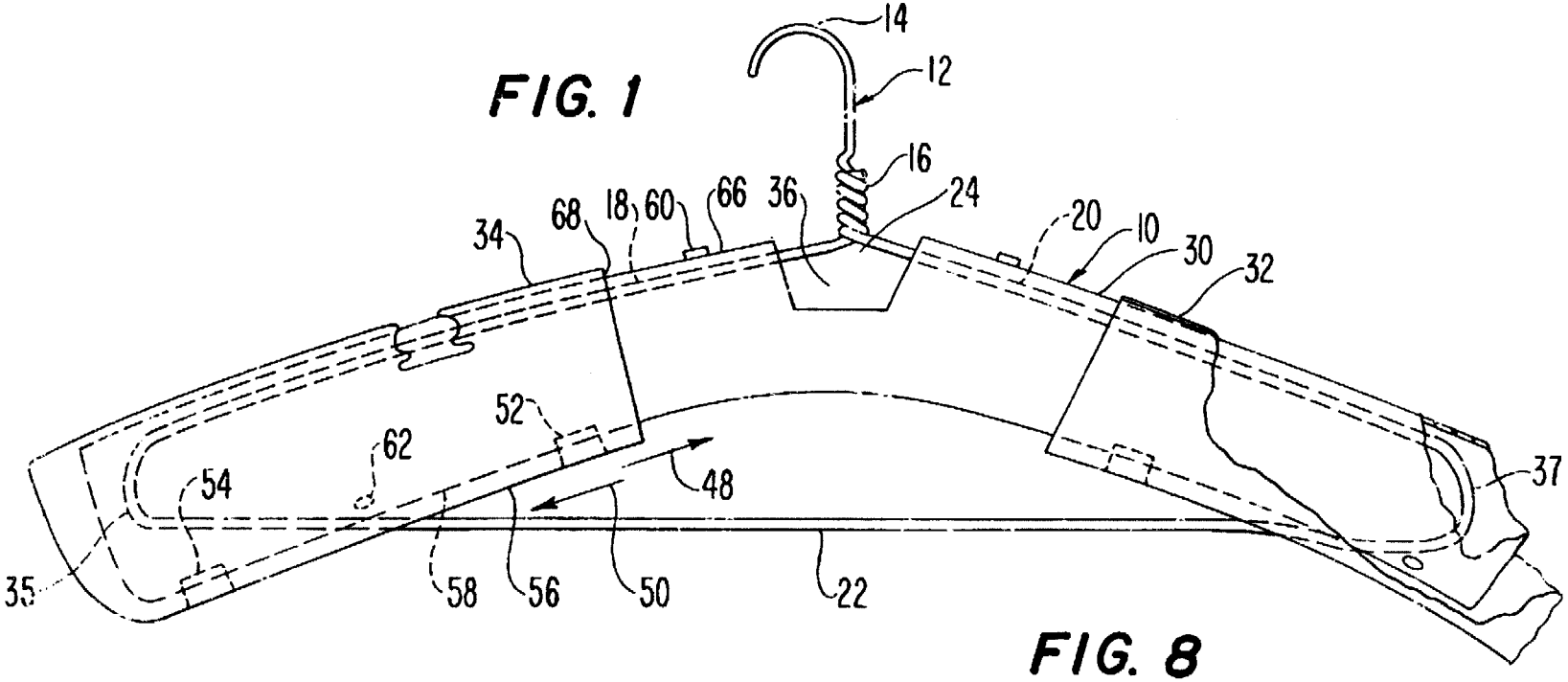
FIG. 1 diagrammatically illustrates the telescopic sleeve overlay being mounted in an operative mode on a wire or rod hanger.

FIG. 1 diagrammatically illustrates one embodiment wherein telescopic sleeve overlay 10 positioned in an operative mode on a wire or stiff rod hanger 12. Hanger 12 includes an inverted V-shaped hanger head 14 and a stem 16 which leads to a shallow inverted V-shaped hanger section formed by hanger members 18 and 20. Hanger 12 also includes a lower member 22 which, together with members 18 and 20, form a closed triangular geometric shape. Members 18 and 20 form an inverted V having a apex at region 24.

Figure 4:
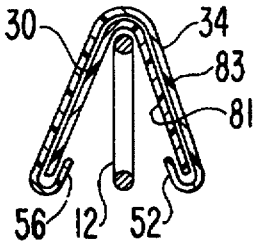
FIG. 4 diagrammatically illustrates the cross-section of the base and one of the movable sleeves from the prospective of section line 4'–4" in FIG. 3.

The telescopic sleeve overlay 10 includes a base 30 and a pair of movable sleeves 32 and 34. Base 30 has an inverted, U-shaped, lateral cross-section which is best shown in FIG. 4. Movable sleeves 32 and 34 also form an inverted U-shape as shown with respect to sleeve 34 resting atop base 30 in FIG. 4. Base 30 extends substantially over the entire length of wire hanger 12. See FIG. 1. The length of wire hanger 12 extends from hanger end 35 to hanger end 37.

Figure 2:
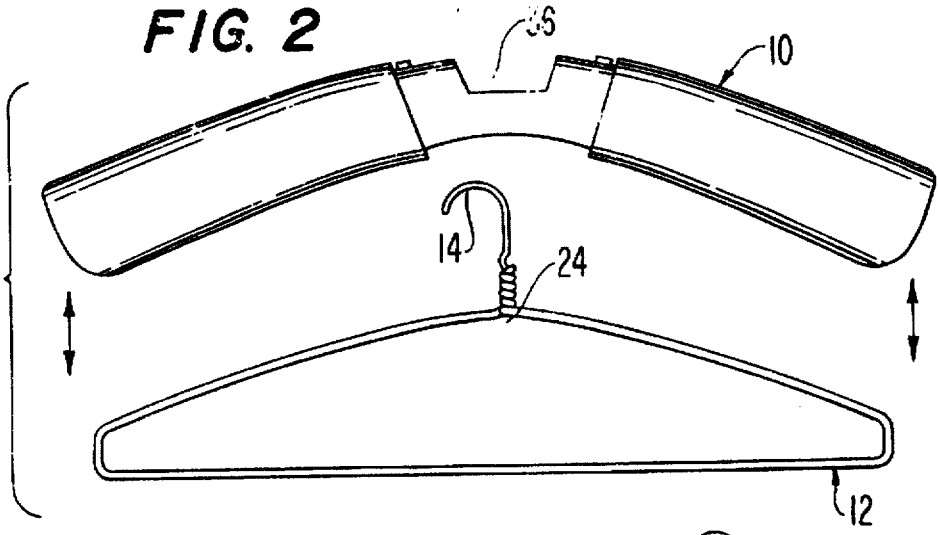
FIG. 2 diagrammatically illustrates the placement of the sleeve overlay on the wire hanger.
Figure 7:
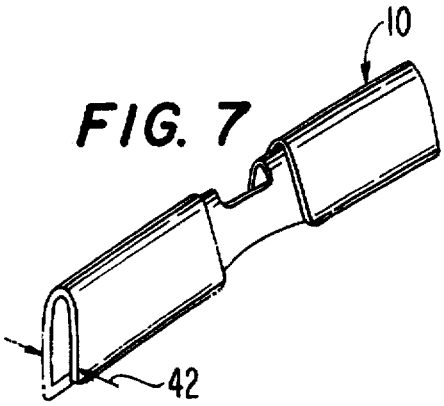
FIG. 7 diagrammatically illustrates the sleeve overlay in a collapsed position (suitable for shipping)

At the center or mid point of base 30, a cut-out 36 is provided. Hanger head 14, stem 16 and hanger apex 24 protrude through cut-out 36. As shown in FIG. 2, cut-out 36 is large enough to accommodate hanger head 14 and apex 24 of a common wire hanger. Accordingly, telescopic sleeve 10 can be easily placed on or removed from the hanger. As a result, the telescopic sleeve overlay 10 can be easily folded flat as shown in FIG. 7. In FIG. 7, the U-shape of both the base and the movable sleeves are collapsed such that the depth 42 of overlay 10 is as small as possible. In use, overlay 10 is expanded to form the inverted U-shape best shown in FIG. 4.

The base 30 has an inverted U-shape and each sleeve 32, 34 has a complimentary inverted U-shape such that the sleeves move inboard and outboard over base 30. As used herein, inboard movement is identified as movement in direction 48 shown by the arrow in FIG. 1. This is movement of sleeve 34 towards central cut-out 36 of base 30. Outboard movement which extends sleeve 34 away from central cut-out 36 is defined as movement in the direction shown by arrow 50 in FIG. 1. Of course, as each sleeve is extended outward in direction 50, the hanger can accommodate clothing articles having broader shoulders.

In the present embodiment, in order to direct the outboard and inboard movement of the sleeve over the base, each movable sleeve includes a number of guides. In FIG. 1, these guides are formed as tabs 52 and 54. These tabs extend from the lower edge 56 of sleeve 34 and wrap around the adjacent lower edge 58 of base 30.

FIG. 4 shows a cross-sectional view of sleeve 34 and tabs 52 and 56. Tab 56 is laterally opposite tab 52. As can be seen in FIG. 4, the inverted U-shape of both the base and the movable sleeves provide better support for clothing articles than the common wire hanger. Further, the telescopic sleeve overlay mimics the approximate size and shape of human shoulders. This is in direct contrast to the thin dimensional width of wire hanger 12. See wire 12 in FIG. 4.

Figure 3:
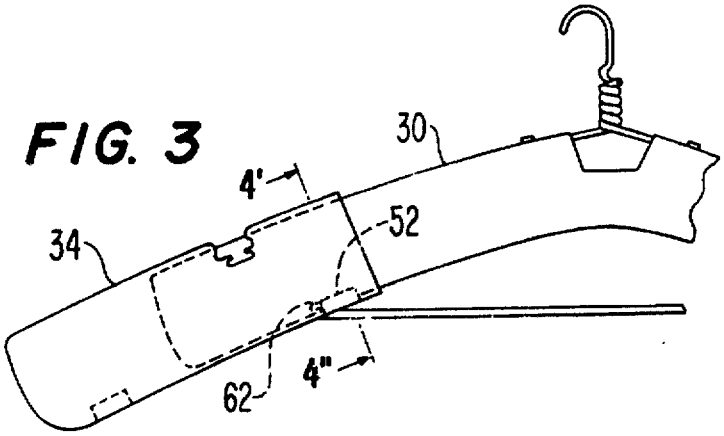
FIG. 3 diagrammatically illustrates the extension of the inverted sleeve on the base of the overlay.

In order to limit the outboard and the inboard movement of the sleeves with respect to the base, a number of mechanical stops are established. In the embodiment illustrated in FIG. 1, the telescopic sleeve overlay 10 includes an inboard stop 60 and an outboard stop 62. Inboard stop 60 is mounted in the illustrated embodiment on an inboard region 66 of base 30. Inboard stop 60 is mounted near cut-out 36. Stop 60 prohibits further inboard movement in direction 48 of sleeve 34 because edge 68 of sleeve 34 abuts stop 60. Of course, the stop could be positioned at any laterally aligned location on the outside surface of base 30 generally in region 66. To prohibit outward or extending movement in direction 50, overlay 10 includes outboard stop 62. Outboard stop 62 abuts guide tab 52 thereby limiting the further extension of sleeve 34 over base 30. In FIG. 3, outboard stop 62 is shown abutting guide tab 52.

The mechanical stops can be made of various configurations. The following Stop Table identifies various mechanical stops which prohibit both inboard and outboard movement of the sleeves over the base.

Stop Table raised buttons, rivets or plugs convex, raised buttons and mating, concave depressions wrap-around tabs plugs or buttons inter locking tabs complimentary ridges It should be noted that the stops can be mounted on the movable sleeves and a complimentary abutment surfaces may be provided on the base.

Figure 5:
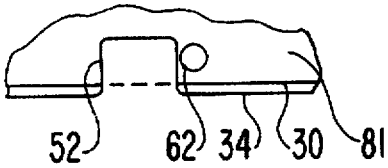
FIG. 5 diagrammatically illustrates a guide and a stop for the telescopic sleeve overlay.

FIG. 5 diagrammatically illustrates outboard stop 62 and guide tab 52. FIG. 5 is a view from a position inside the inverted U sleeve overlay directed outward. Accordingly, surface 81 is the inboard or inside surface of base 30. In contrast, surface 83 is the outboard surface of sleeve 34.

Figure 6:
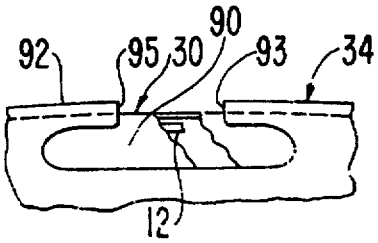
FIG. 6 diagrammatically illustrates a strap cut-out on the apex of one of the movable inverted V-shaped sleeves.

FIG. 6 diagrammatically illustrates a strap cut-out 90 formed at the top edge 92 of sleeve 34. Strap cut-out 90 is generally key hole shaped and consists of a mouth defined by opposing edges 93, 95 which open into a larger cut-out or throat. In FIG. 6, wire hanger 12 is illustrated beneath the broken away view of base 30. Certain components of the U-shaped base 30 having been broken away to reveal fore and aft surfaces of the base and wire hanger 12.

Figure 8:
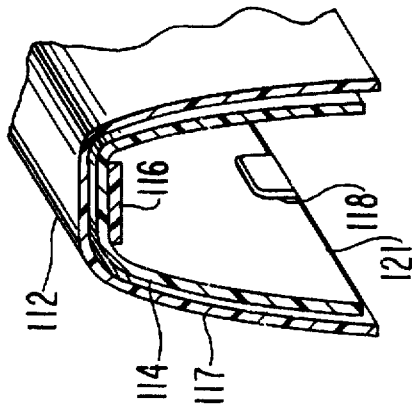
FIG. 8 diagrammatically illustrates the plastic reinforcement member disposed in the apex of the base.

FIG. 8 diagrammatically illustrates another embodiment of in the present invention. In this embodiment, movable sleeve 112 moves over base 114. Base 114 and sleeve 112 are made of paper and most preferably are made of a cardboard material. In order to reinforce the cardboard base 14, a plastic reinforcement member or bar 116 is provided in the apex of the inverted U-shape. Guide tab 118 from movable sleeve 117 is shown wrapping around lower edge 121 of base 114.

Figure 9:
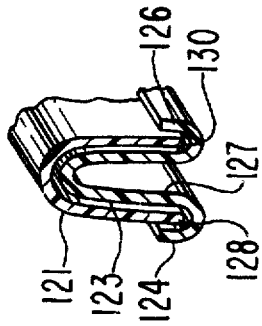
FIG. 9 diagrammatically illustrates another type of guide formed by the base.

FIG. 9 diagrammatically illustrates another mechanism to guide movable sleeve 121 over base 123. In this embodiment, base 123 includes opposing guides formed by up turned, U-shaped legs 124 and 126. Edges 128 and 130 of movable sleeve 121 move in the channel formed by up turned guide legs 124 and 126 depending from base 127.

In one embodiment, all elements of the telescopic sleeve overlay are made of plastic.

FIGS. 10–13 illustrate another embodiment of the present invention relating to a garment hanger with telescoping sleeves. Some of the features from the telescopic sleeve overlay shown in FIGS. 1–9 may be carried over to the garment hanger described in connection with FIGS. 10–13.

Figure 10:
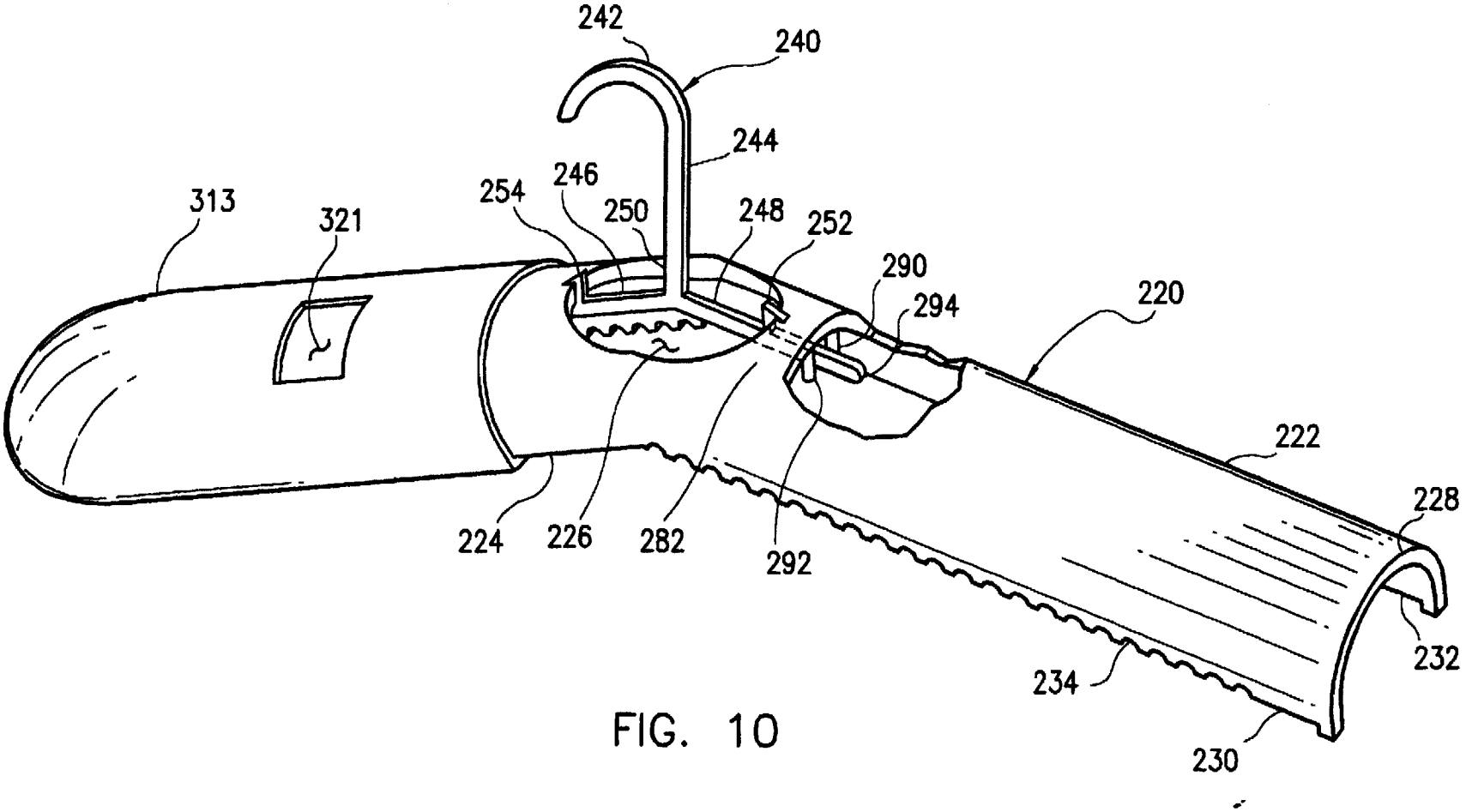
FIG. 10 diagrammatically illustrates a garment hanger with telescoping sleeves and a removable, clip-on and off hanger hook.

FIG. 10 diagrammatically illustrates garment hanger 220 having a first base portion 222 and a second base portion 224. A cut-out 226 is disposed in a central region near the intersection of the base portions 222, 224. The base portions have inverted, U-shaped lateral cross-sections. This is best shown in connection with base portion 222 and longitudinal edge region 228. In one preferred embodiment, each base portion includes a longitudinal edge 230 and 232. Longitudinal edges 230, 232 are laterally opposite each other, that is, they are disposed at opposite ends of the U-shaped lateral cross-section of base portion 228. In one embodiment, each longitudinal edge 230, 232 includes a plurality of positional concavities or cut-outs, one of which is identified as concave cut-out 234. As discussed later in connection with FIG. 12 which shows an index on the sleeve guide channel, the index temporarily locks into laterally aligned concave cavities such that the sleeve has a plurality of digital locking positions along the longitudinal aspect of base portion 222 or base portion 224. Longitudinal edge 232 includes a complementary set of positional concavities. Each concave cut-out on edge 232 is aligned, in a lateral sense, with a concave cut-out on edge 230. Rather than concave cut-outs, edges 232, 230 can include sawteeth.

The garment hanger further includes a removable hanger head 240. Hanger head 240 includes an inverted U-shaped hanger hook 242, a vertically disposed hanger body 244 and a pair of opposing legs 246, 248 that extend opposite each other from a base 250 of hanger head 240. Each leg further includes an upstanding clip tab 252, 254.

Figure 11A:
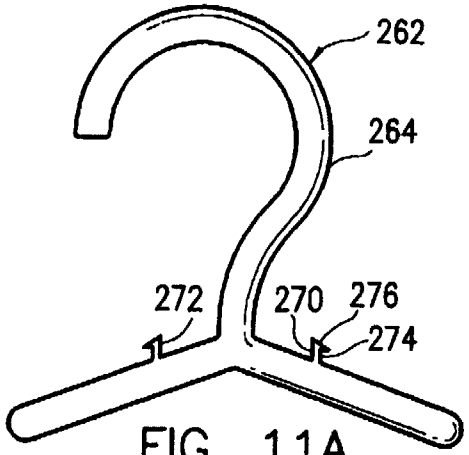
FIGS. 11A and 11B diagrammatically illustrate different hanger hooks.
Figure 11B:
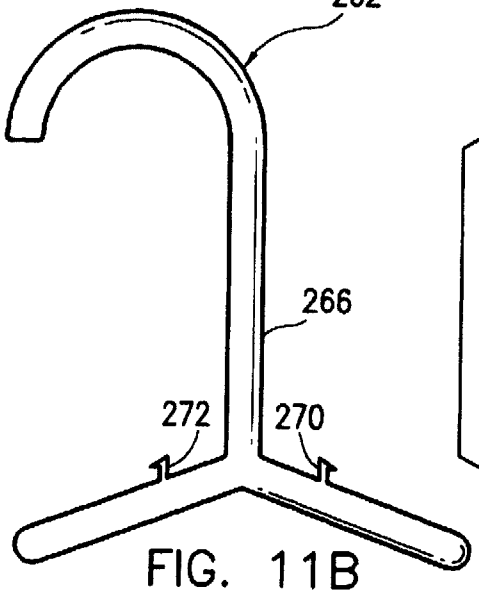

The hanger heads 260 and 262 illustrated in FIGS. 11A and 11B have different body regions 264, 266. Hanger head 260 has a short body length and, hence, the clothing mounted on garment 220 (FIG. 10) is closely positioned with respect to a rod positioned beneath hanger hook 242 in comparison with hanger head 262. Vertical body 266 is much larger or longer than vertical body 264. Both hanger heads 260, 262 include upstanding clip tabs 270, 272. Clip tabs 270 include a vertical upright portion 274 and a head 276. Head 276 has an outwardly extending edge face such that when hanger head 260 is placed in cut-out 266 (FIG. 10), the outwardly extending head portion or ledge clips over surface 282 of base 222.

Returning to FIG. 10, the legs 248, 246 of hanger head 260 extend within and beneath the U-shaped base 222, 244. In a preferred embodiment, the legs are retained in a longitudinally aligned position by guideposts 290, 292. As shown in FIG. 10, leg 248 has a terminal end 294 that extends longitudinally beyond guideposts 290, 292. Of course, guideposts 290, 292 form a guide channel for the hanger head leg. Leg 246 is retained in position by another set of guideposts or channel defining structure beneath U-shaped base 224.

The present invention can utilize a plurality of hanger heads. Each hanger head may be a different color and further may have a different vertical body length. Different colored hanger heads can be utilized to designate different sizes of clothing, different manufacturers, different styles of clothing as selected by the retailer. Since the hanger heads are differently sized, a single garment hanger comprising a base and a pair of sleeves can be utilized in conjunction with a plurality of different colored and different sized hanger heads. These hanger heads can be easily removed from the base simply by compressing legs 246, 248 inward towards base 250. This compression causes the clip tabs to move inward in cut-out 226 thereby releasing the hanger head from the base and the cut-out. Different hanger heads can be "snapped" into place by inserting the hanger head vertically upward into cut-out 226 and clipping the hanger head onto base 222, 224.

Figure 12:
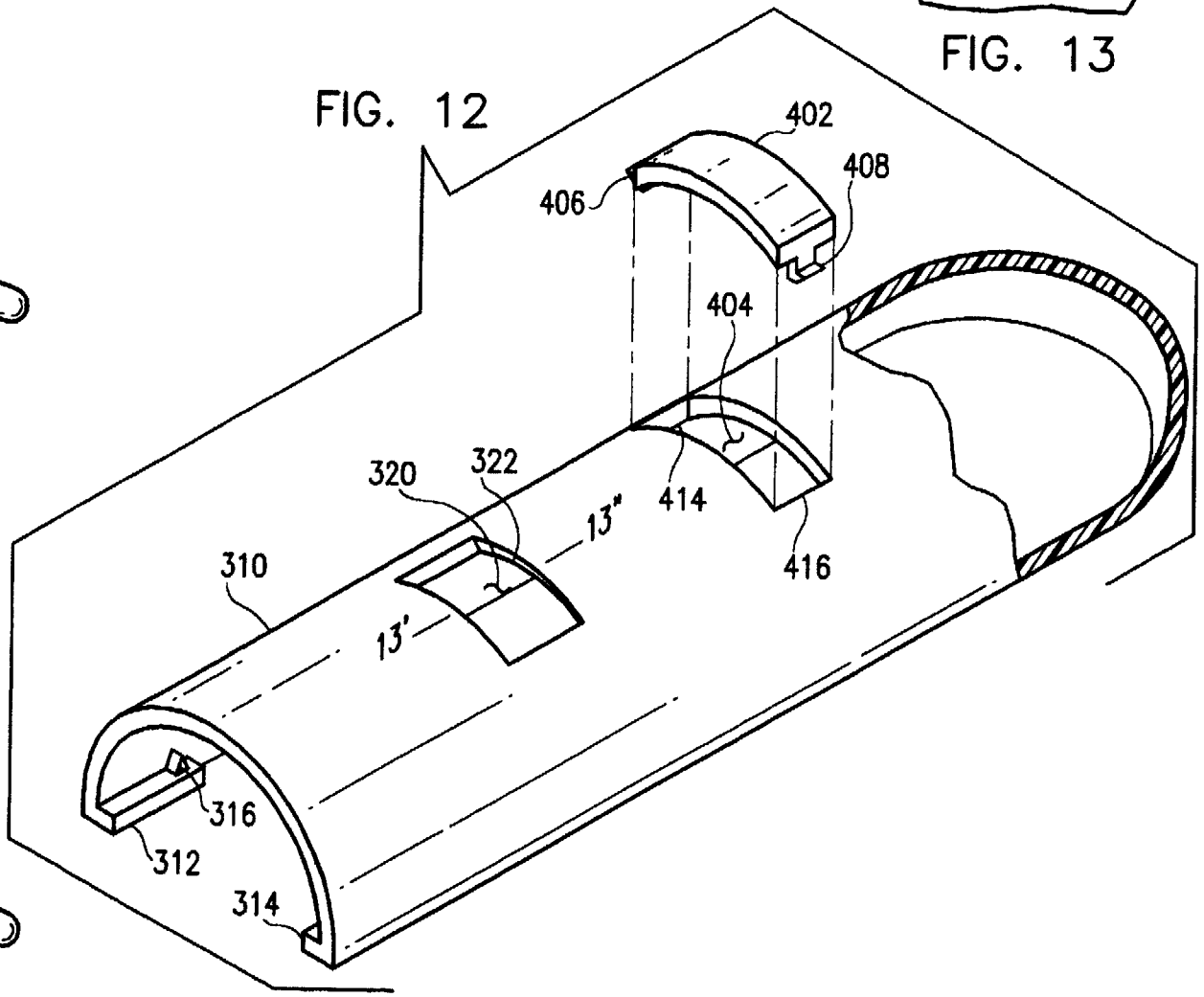
FIG. 12 diagrammatically illustrates a movable sleeve with a removable name plate.

FIG. 12 diagrammatically illustrates a movable sleeve 310. Sleeve 310 is an inverted, U-shaped sleeve. The shape and size of U-shaped sleeve 310 matches the shape and size of base section 222 in FIG. 10. Movable sleeve 310 includes an radially inward directed lip or ledge 312, 314. At an inboard position on these guide lips, an indexing tab 316 is formed. Indexing tab 315 coacts with one or more of the plurality of concavities, one of which is concave cut-out 234 on edge 230. Radially inward extending lip 314 includes another indexing tab (not shown) which indexes onto a laterally aligned concavity on the opposing longitudinal edge of the base portion. In this manner, digital positioning of movable sleeve 310 is provided on base portion 222. Of course, base portion 224 has movable sleeve 313 mounted thereon.

Figure 13:
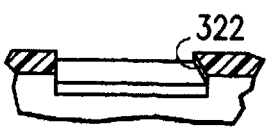
FIG. 13 illustrates a partial, broken away view of the strap cut-out from the perspective of section line 13'–13" in FIG. 12.

In a preferred embodiment, sleeves 310, 313 include strap cut-outs 320, 321. Strap cut-out 320 in FIG. 12 has an angulated edge 322. Angulated edge 322 is best shown in FIG. 13. Angulated edge 322 enables the capture and quick retention of a clothing strap associated with a piece of clothing. Since sleeve 310 can be moved in a digital manner along the length of base 222, the strap cut-out 320 can be positioned to accommodate a wide variety of clothing.

A further enhancement of the present invention is shown with respect to removable nameplate 402. Nameplate 402 snaps into and out of nameplate cut-out 404. One type of removable mechanism includes extending clip tabs 406 and 408. Clip tabs 406, 408 clip on the underside of the U-shaped sleeve 310 along edges 414 and 416. The utilization of removable nameplates 402 enables the retailer to customize the garment hanger. This further enhances the value of the garment hanger and provides additional advertising and recognition for the retailer or clothing manufacturer.

The claims appended hereto are meant to cover modifications and changes within the spirit and scope of the present invention.

What is claimed is:

1. A garment hanger with telescoping sleeves comprising:

a hanger head having an inverted U-shaped hanger hook and a pair of legs extending in opposite directions from a base portion of said hanger hook, each leg having an upstanding clip tab thereat;

an elongated base having an inverted U-shaped lateral cross-section and having a longitudinally centered cut-out through which protrudes, in a first operative mode, said hanger head, each upstanding clip tab removably locking onto an edge portion defining said cut-out;

a pair of longitudinally movable, inverted U-shaped sleeves movably mounted atop opposing end regions of said inverted U-shaped base, each sleeve covering, in a fully retracted operative mode, substantially the entire end region of said base which is approximately one-half of the length of said inverted U-shaped base, and exposing, in a fully extended operative mode, at least one quarter of said inverted U-shaped base; and a strap cut-out at an apex of each said inverted U-shaped sleeve, said cut-out disposed at a median, longitudinal position whereby said sleeves and said strap cut-out are longitudinally movably adjusted to accommodate one or more clothing straps.

2. A garment hanger as claimed in claim 1 including a pair of inboard stops mounted on or formed on an inboard region of said base near said centered cut-out, each said inboard stop prohibiting further inboard movement of a respective movable sleeve towards said centered cut-out over said corresponding base, and further including a pair of outboard stops mounted or formed on an outboard region of said base near the end of said base, each said outboard stop prohibiting further outboard and extending movement of a respective movable sleeve away from said centered cut-out over said corresponding base.

3. A garment hanger as claimed in claim 1 wherein said base and said sleeves are made of a plastic material.

4. A garment hanger as claimed in claim 1 wherein said base has a first and a second depending guide, each guide located near said cut-out and on opposing regions thereof, each said depending guide sized and located to capture a respective leg of said hanger head.

5. A garment hanger as claimed in claim 1 wherein said base defines a first and a second opposing longitudinal edge on either lateral side of said U-shaped base, each longitudinal edge having a plurality of positional concavities therealong; each said sleeve defining a first and a second opposing sleeve channel on either lateral side of said U-shaped sleeve, said first and second sleeve channel sized to capture a respective plurality of positional concavities thereby providing a plurality of digital locking positions for each said sleeve on said base.

6. A garment hanger as claimed in claim 5 wherein each said sleeve channel includes an indexing tab which fits within said respective positional cavity on the corresponding longitudinal edge of said base.

7. A garment hanger as claimed in claim 6 including a pair of outboard stops mounted or formed on an outboard region of said base near the end of said base, each said outboard stop prohibiting further outboard and extending movement of a respective movable sleeve away from said centered cut-out over said corresponding base by abutment against a corresponding stop on a respective sleeve.

8. A garment hanger as claimed in claim 1 wherein said strap cut-out at the apex of each said inverted U-shaped sleeve is formed with a narrow mouth at said apex which leads to a wider cut-away mid-section whereby said clothing strap is captured by said wider cut-away mid-section.

9. A garment hanger as claimed in claim 2 including at least two pair of guides formed on laterally opposed edges of said base, each pair cooperating with a respective movable sleeve, said guides formed of one of a channel formed at a lower edge of said inverted U-shaped base and a channel formed at a lower edge of said inverted U-shaped movable sleeve, said channel guiding the movement of said respective movable sleeve over said base.

10. A garment hanger as claimed in claim 9 wherein said guide is formed by a tab extending from said lower edge of said respective movable sleeve, said tab partially wrapping around the corresponding lower edge portion of said base.

11. A garment hanger as claimed in claim 10 wherein said pair of outboard stops located near the end of said base prohibits further outboard and extending movement of a respective movable sleeve away from said centered cut-out over said corresponding base by abutment against a corresponding guide tab.

12. A garment hanger as claimed in claim 1 wherein said hanger, in a second operative mode, defines a kit comprising a plurality of different colored hanger heads, a base and a pair of movable sleeves, each one of said difference colored hanger heads representing one from the group consisting of different sizes of clothing, difference prices of clothing and different manufacturers of clothing.

13. A garment hanger as claimed in claim 12 wherein said base and said sleeves are made of a plastic material.

14. A garment hanger with telescoping sleeves comprising:

a hanger head having an inverted U-shaped hanger hook and a pair of legs extending in opposite directions from a base portion of said hanger hook, each leg having an upstanding clip tab thereat;

an elongated base having an inverted U-shaped lateral cross-section and having a longitudinally centered cut-out through which protrudes, in a first operative mode, said hanger head, each upstanding clip tab removably locking onto an edge portion defining said cut-out;

a pair of longitudinally movable, inverted U-shaped sleeves movably mounted atop opposing end regions of said inverted U-shaped base, each sleeve covering, in a fully retracted operative mode, substantially the entire end region of said base which is approximately one-half of the length of said inverted U-shaped base, and exposing, in a fully extended operative mode, at least one quarter of said inverted U-shaped base;

said base has a first and a second depending guide, each guide located near said cut-out and on opposing regions thereof, each said depending guide sized and located to capture a respective leg of said hanger head.

15. A garment hanger as claimed in claim 14 wherein a plurality of hanger heads are utilized, each hanger head having a different body length such that a user can select a hanger head length matched to a piece of clothing retained by said garment hanger.

16. A garment hanger as claimed in claim 15 wherein said hanger, in a second operative mode, defines a kit comprising a plurality of different colored hanger heads, a base and a pair of movable sleeves, each one of said difference colored hanger heads representing one from the group consisting of different sizes of clothing, difference prices of clothing and different manufacturers of clothing.

* * * * *